343-700 MS AU 254 EX
9/14/82 4,349,824

United States Patent [19] [11] 4,349,824
343/700MS Harris [45] Sep. 14, 1982

[54] AROUND-A-MAST QUADRIFILAR MICROSTRIP ANTENNA

[75] Inventor: Eleanor S. Harris, Guilford, Conn.

[73] Assignee: The United States of America as represented by the Secretary of the Navy, Washington, D.C.

[21] Appl. No.: 192,742

[22] Filed: Oct. 1, 1980

[51] Int. Cl.[3] ..... H01Q 1/34; H01Q 1/36
[52] U.S. Cl. ..... 343/700 MS; 343/709; 343/895
[58] Field of Search ..... 343/700 MS, 895, 709, 343/710, 854

[56] References Cited

U.S. PATENT DOCUMENTS

| | | | |
|---|---|---|---|
| 3,906,509 | 9/1975 | Du Hamel | 343/895 |
| 4,008,479 | 2/1977 | Smith | 343/895 |
| 4,204,212 | 5/1980 | Sindoris et al. | 343/700 MS |

*Primary Examiner*—Eli Lieberman
*Attorney, Agent, or Firm*—R. S. Sciascia; P. C. Lall

[57] ABSTRACT

A down link UHF antenna is designed which includes four equispaced arms metal plated at an angle on a fiberglass cylinder. A coaxial connector is connected to each of the four arms with the metal plated inner surface as the common ground.

11 Claims, 5 Drawing Figures

AROUND-A-MAST QUADRIFILAR MICROSTRIP ANTENNA

BACKGROUND OF THE INVENTION

The present invention generally relates to antenna systems and more particularly to a down link antenna for communication satellites.

Common conventional radio frequency antennas are unsuitable for use in the mid section of the mast of a periscope for communicating with communication satellites. One of the problems in using such antennas is the large dimensions in the designated frequency range particularly when circular polarization is required. As an example, two cross dipoles used as an antenna for a periscope will have to be large in dimensions in the frequency range of 200–300 $MH_z$ and it will be difficult to integrate such an antenna in the mast of a periscope. Furthermore, the antenna should be virtually height independent with respect to the ground plane which is critical for mast-mounted submarine antennas. Furthermore, an antenna when mounted on a major periscope should provide reliable communication reception from satellite without raising of the dedicated satellite communication antenna mast. Thus, there is a need for an antenna to be used for a major periscope to provide reliable communication reception from satellites which has small enough size and also can be fitted into a periscope.

SUMMARY OF THE INVENTION

A down link antenna for communication satellites to be fitted on major periscopes is an arrangement which can be integrated in a periscope's mast and particularly into the area of its sleeve's dielectric spacer and feed. The antenna is a UHF (ultrahigh frequency) antenna with a center frequency of 250 megahertz ($MH_z$) for use with communication satellites. It includes four equispaced arms, preferably each of one inch width and a nominal length of $\frac{3}{4}\lambda$ ($\lambda$ being the wave length of the signal), which are metal plated at an angle, preferably at an angle of 15 degrees, on a fiberglass cylinder. A coaxial connector is connected to each of the four arms with the metal plated inner surface as the common ground. Interior or the inner side of the fiberglass cylinder is also metal plated.

An object of subject invention is a UHF down link antenna which is extremely small in size to operate at the designated frequency.

Another object of subject invention is to have an antenna which may be used as a section in a cylindrical mast wherein cables, wave guides optic column, etc. are fed through the length of the antenna section, thus allowing the antenna to be integrated into the mast below existing sensors with no change to the feed systems of the sensors.

Still another object of subject invention is to have a down link UHF antenna which can be integrated into the mast of a periscope in the area of its sleeve's dielectric spacer and feed.

Still another object of subject invention is to have a UHF down link antenna which is virtually height independent with respect to the ground plane which is critical for the mast mounted submarine antennas.

Still another object of subject invention is to have an antenna which can be mounted on a major periscope to provide reliable communication reception from satellites without raising of the dedicated satellite communications antenna mast.

Still another object of subject invention is to have a UHF antenna for fitting periscopes which is mechanically sound particularly when G-10 fiberglass is used as the dielectric therefor.

Other objects, advantages and novel features of the invention will become apparent from the following detailed description of the drawings when considered in conjunction with the accompanying drawings wherein:

DESCRIPTION OF A PREFERRED EMBODIMENT

Figure 1:
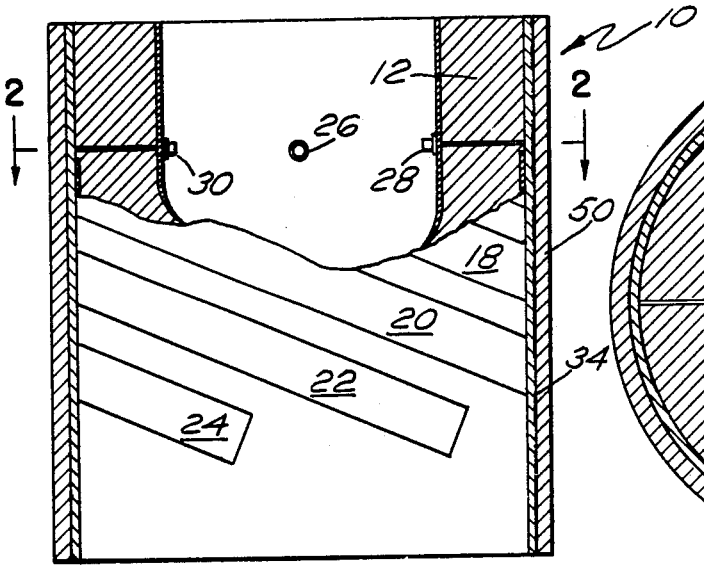
FIG. 1 is a cross-sectional view of the antenna built according to the teachings of subject invention.
Figure 2:
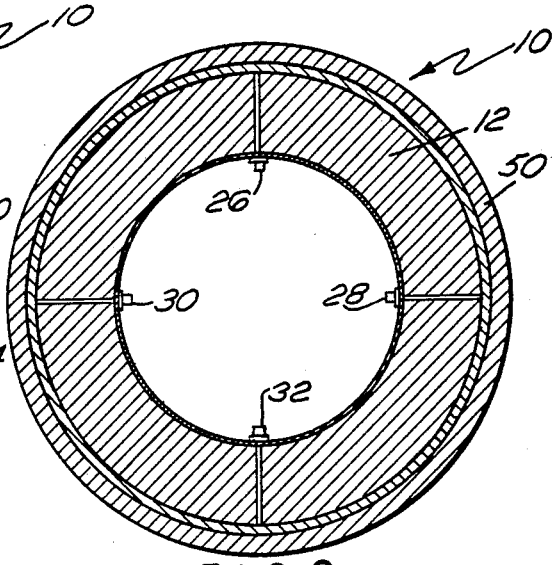
FIG. 2 is top view of the antenna of FIG. 1.
Figure 4:
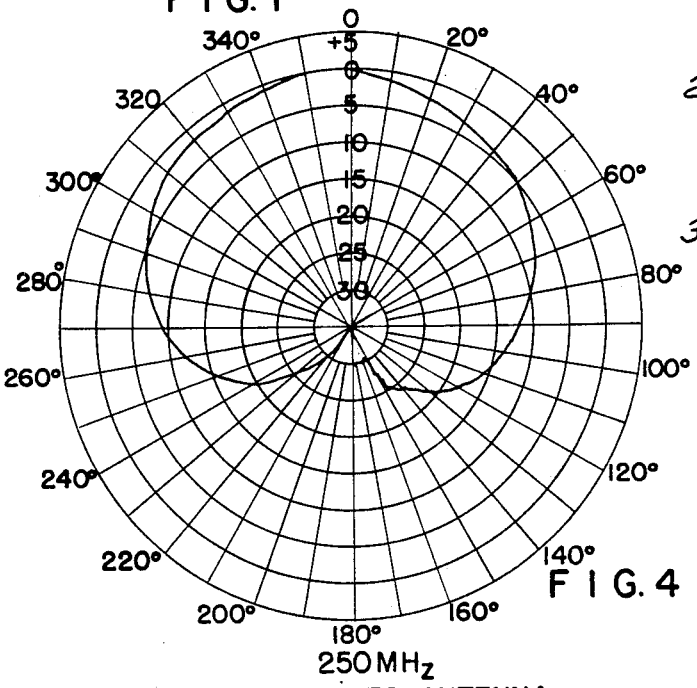
FIG. 4 is an overhead elevation pattern of a quadrifilar antenna in free space.
Figure 3:
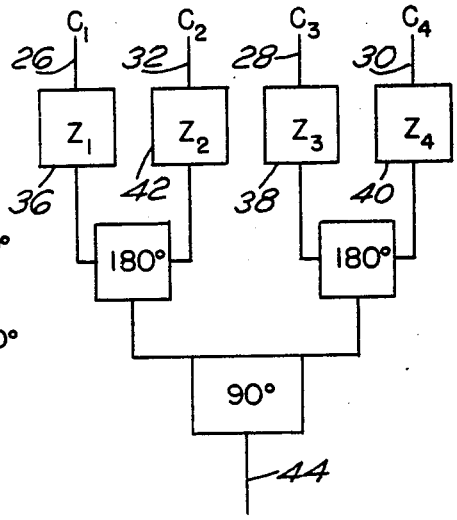
FIG. 3 is a block diagram of the feed system used in the antenna of FIG. 1.

Referring to the drawings, FIG. 1 shows a cross-sectional view of an electrical antenna built according to the teachings of subject invention. Antenna 10 includes a fiberglass cylinder 12 preferably made of G-10 fiberglass and having a dielectric constant $\epsilon$ and the cylinder is preferably 8 inches long and with an outside diameter of 7.25 inches and internal diameter of 4.5 inches. However, it should be well understood that these features of the cylinder or material can be varied without deviating from the teachings of subject invention. Fiberglass cylinder 12 is coated with metallic plating on the inside as well as at the top and bottom surfaces thereof. Cylinder 12 has four equispaced and generally parallel arms 18, 20, 22 and 24, preferably each arm being one inch wide. Arms 18, 20, 22 and 24 are metal plated at an angle, preferably making an angle of 15 degrees with a plane perpendicular to the axis of the cylinder 10 on the outer surface thereof. Each of the coaxial connectors 26, 28, 30 and 32 is connected to its respective arm in such a way that each of these connectors is attached to the plate of the interior ground connection acting as a ground connection and the central pin of each connector feeds its respective arm. The arms 18, 20, 22 and 24 may be fine tuned independently or in pairs to resonant length for desired frequency. A matching network for this model is 25 ohms, but it varies with the thickness of the fiberglass used. However, the arms are coupled and the length of each arm is approximately equal to $$\frac{3}{4}\frac{\lambda}{\sqrt{\epsilon}}$$

where $\lambda$ is the wave length of the signal. Feeding arms 18, 20, 22 and 24 in phase quadrature results in a cardiodal pattern in free space with a maximum gain being on axis as shown in FIG. 4. The embodiment shown in FIGS. 1–3 is that of a right-hand circularly polarized antenna. The feed system of the antenna is shown in a block diagram form in FIG. 3 where each of the connectors 26, 28, 30 and 32 is connected to a respective member of impedances 36, 38, 40 and 42. The output at connectors 26 and 32 through their matching networks 36 and 42 are out of phase by 180 degrees. Likewise the outputs at connectors 28 and 30 are delayed from one another by 180 degrees. The combined output of connectors 26, 32 and the combined output of connectors 28 and 30 are delayed from one another by 90 degrees in order to get the output 44. As shown in FIGS. 1 and 2, a radome 50 maybe used around cylinder 12 to make it pressure proof.

Figure 5:
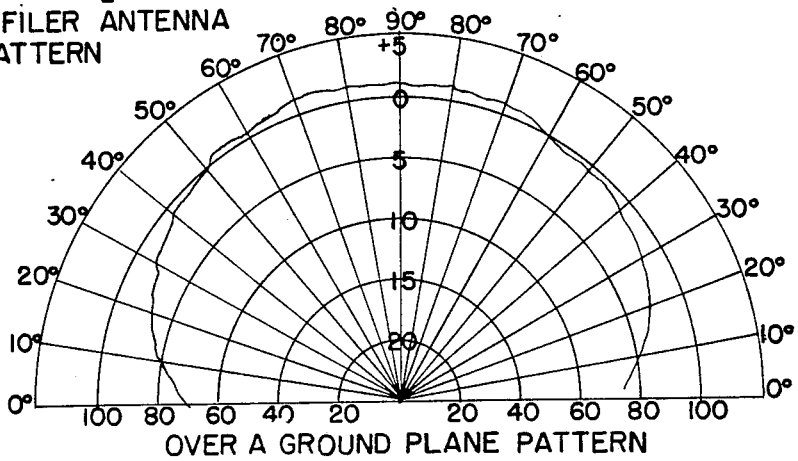
FIG. 5 is an overhead elevation pattern for the antenna response over a ground plane with the antenna mounted in the mid section of the periscope mast.

FIG. 4 shows a free space pattern which is independent of height, i.e., there is no signal received from the bottom of the antenna. FIG. 5 is a graphical representation of the distribution of the signal when the antenna is placed over a ground plane and mounted in a section of the mast of a periscope which simulates a periscope sticking out of the water and the satellite at various angles above the horizon. Thus FIG. 5 gives a typical pattern above a ground plane. This pattern is almost the same pattern regardless of the position of the antenna above the ground plane within the normal operating range of the periscope.

Briefly stated, a UHF around-a-mast quadrifilled microstrip antenna which includes a cylindrical fiberglass cylinder which has four equispaced metallic strips plated thereon at an angle, preferably an angle of 15 degrees and the inner top and bottom surfaces of the cylinder are metal plated. A coaxial connector is attached to each of the arms and a radome is added for pressure proofing.

Obviously, many modifications and variations of the present invention may become apparent in the light of the above teachings. As an example, the material used for the cylinder and radome can be changed without by its equivalent materials. Furthermore, the metal arms plated on the fiberglass cylinder may be placed at an angle other than 15 degrees for appropriate use. Furthermore, the material of the radome to pressure proof can also be changed by something equivalent thereto. The antenna can be made right-hand of left-hand circularly polarized by positioning the wide arms on the fiberglass cylinder. It is therefore understood that within the scope of the appended claims, the invention may be practiced otherwise than as specifically described.

What is claimed is:

1. An Around-A-Mast quadrifilar microstrip antenna for the periscope of a submarine which comprises:

a cylinder of a non-conductive material having metal plated at the top, bottom and inner surfaces thereof and forming a common ground plane from the top, bottom and inner surfaces;

a plurality of generally parallel conductive bands electrically isolated from said common ground plane on the outer surface of said cylinder;

connecting means for each member of said plurality of conductive bands on the outer surface of said cylinder; and matching networks for delaying appropriately the outputs from each member of said plurality of conductive bands on the outer surface of said cylinder.

2. The antenna of claim 1 wherein said non-conductive material of said cylinder is fiberglass G-10.

3. The antenna of claim 2 wherein said plurality of generally parallel conductive bands include four generally parallel copper bands metal plated on the outer surface of said cylinder.

4. The antenna of claim 3 wherein said four generally parallel copper bands make an angle of 15 degrees with a plane perpendicular to the axis of said cylinder.

5. The antenna of claim 4 wherein said four generally parallel copper bands metal plated on the outer surface of said cylinder wrap around the outer surface of said cylinder so as to make the antenna right-hand circularly polarized.

6. The antenna of claim 4 wherein said four generally parallel copper bands metal plated on the outer surface of said cylinder wrap around the outer surface of said cylinder so as to make the antenna left-hand circularly polarized.

7. The antenna of claim 4 which further includes a radome around said cylinder for pressure proofing the antenna.

8. The antenna of claim 1 wherein the inner metal plated surface of said cylinder is used as a common ground terminal.

9. The antenna of claim 8 wherein said matching networks and the outputs from each of connecting means are fed through the inner volume of said cylinder and the antenna being an integral part of the mast of the periscope.

10. The antenna of claim 1 wherein said matching networks for delaying appropriately the outputs of each member of said plurality of conductive bands on the outer surface of said cylinder includes at least a pair of 180° phase shifters, one member of said pair being connected to a first set of two oppositely disposed conductive bands on the outer surface of said non-conductive cylinder and the second member of said pair of 180° phase shifters being connected to a second set of oppositely disposed conductive bands on the outer of said non-conductive cylinder.

11. The antenna of claim 10 which further includes at least a 90° phase shifter being connected between the outputs of said pair of 180° phase shifters in order to add the signals from said first and second sets of conductive bands on the outer surface of said non-conductive cylinder.

* * * * *